United States Patent [19]

Kim et al.

[11] 4,418,706

[45] Dec. 6, 1983

[54] METHOD FOR EXPANDING TOBACCO AND APPARATUS THEREFOR

[75] Inventors: Ki-Hwan Kim; Kwang-Keun Yoo; Tae-Ho Lee, all of Seoul, Rep. of Korea

[73] Assignee: Office of Monopoly, Seoul, Rep. of Korea

[21] Appl. No.: 304,057

[22] Filed: Sep. 21, 1981

[51] Int. Cl.[3] ..... A24B 3/18

[52] U.S. Cl. ..... 131/296; 131/303; 131/304

[58] Field of Search ..... 131/291, 296, 300–304

[56] References Cited

U.S. PATENT DOCUMENTS 3,409,027 11/1968 de la Burde ..... 131/291
4,040,431 8/1977 Ashworth et al. ..... 131/296
4,044,780 8/1977 Kelly ..... 131/303
4,211,243 7/1980 Ohno et al. ..... 131/296

*Primary Examiner*—V. Millin
*Attorney, Agent, or Firm*—Holman & Stern

[57] ABSTRACT

Tobacco stems are expanded by superheated steam in a U-shaped, tubular expansion device, which is provided with a venturi tube and cooling jackets. The superheated steam under high pressure is ejected toward the venturi tube. The rapid speed of the steam stream creates a Bernoulli flow, namely strong suction force in the venturi tube. By this force, the tobacco stems, which are being continuously supplied into a hopper from a tobacco cutter, are automatically sucked into the expansion device via the venturi tube. Tobacco stems primarily expanded in the expansion device are sent to a cyclone system and further puffed therein.

15 Claims, 2 Drawing Figures

METHOD FOR EXPANDING TOBACCO AND APPARATUS THEREFOR

FIELD OF THE INVENTION

This invention relates to a method for expanding tobacco. More particularly, this invention relates to a method and apparatus for enhancing the filling capacity by treating the stems and slivers of the cut tobacco with superheated steam.

BACKGROUND OF THE INVENTION

Conventional tobacco stem processed products are rough to the touch and have a greater gravity than leaf flesh tobacco. When the products are used for smoking articles such as cigarettes, they cause an irregularity in the cigarette and undesirable taste due to improper smoke components produced by burning. In addition, the tobacco stems contain more fibers and lignin compared to a tobacco lamina and therefore using the stems gives a fibrous or stimulative smell to the tobacco products.

Various proposals have been made for expanding tobacco stems in order to improve the properties of the stems. Illustrative of prior art in relation to tobacco expansion are as set forth below:

U.S. Pat. No. 3,957,063 to Wochnowski is directed to a method and apparatus for increasing the volume of moist tobacco, wherein particles of a tobacco stream are first expanded by passing through a high-frequency field wherein the particles are exposed to the action of electromagnetic waves which cause a vaporization of moisture in the capillaries with an attendant increase in volume. Thereafter, the expanded particles are introduced into a drying zone by a vibratory conveyor or by a current of a gaseous coolant. In this patent, an increase in volume of up to 50 percent is achieved. Other U.S. Pat. Nos. 3,409,023 and 3,409,027 also disclose the methods similar to the above U.S. Pat. No. 3,957,063.

U.S. Pat. No. 3,704,716 to Abbot, et al., describes a method for the continuous processing of tobacco to expand the tobacco, wherein shredded tobacco is moistened with water to a point at which its volume is about twice the initial volume, continuously moved to a freeze chamber and then to a freeze drying chamber wherein 90 percent of the moisture is removed. Similar methods are available in U.S. Pat. Nos. 3,785,385; 3,823,722; and 3,982,550.

Another U.S. Pat. No. 3,409,022, to de la Burde, relates to a method for puffing tobacco stems, wherein tobacco stems, containing at least 4% to 23% moisture are subject to a radiant energy source under predetermined conditions. By this method, a number of micropores can be created in tobacco stems.

Still another U.S. Pat. No. 3,524,452, to Moser, et al., discloses a method for increasing the filling capacity of tobacco, which comprises wetting a tobacco stream with a volatile organic compound, such as halogenated hydrocarbons, and rapidly vaporizing the liquid from the tobacco by passing the tobacco stream into contact with a rapidly moving stream of gas heated to a temperature above the boiling point of the organic liquid. In this method, the tobacco is expanded in a short period, less than about 4 seconds. Similar processes are available in U.S. Pat. Nos. 3,541,452 and 3,575,178.

Other prior patents describing water or steam treatment have been suggested for puffing tobacco stems. For example, U.S. Pat. No. 4,211,243 to Ohno proposes a method for expanding tobacco stems wherein expanded tobacco stems are produced by heating under pressure tobacco stems which have been separated from tobacco leaves after moisturization at a predetermined pressure and temperature in the presence of superheated steam for 30 seconds or less, and suddenly bringing the pressure to a lower level to cause expanding. U.S. Pat. No. 3,799,176 to Wochnowski relates to a process for processing tobacco, wherein particles of the tobacco stems having a predetermined moisture content, are subjected to the action of a current of a hot gaseous fluid for three successive steps to control the moisture content. U.S. Pat. No. 4,195,647 to Wochnowski, et al, is directed to a method for increasing the volume of tobacco, wherein shredded tobacco is contacted by an upstream of saturated steam and a shower of hot water droplets, the temperature and moisture content of the tobacco thereby increase to a value at which the tobacco is flexible, and thereafter, it is continuously conveyed to a drying unit. In this unit, the shredded tobacco rises and falls while moving across an upstream containing a mixture of superheated water vapors and hot air, thereupon the dried shreds are cooled to room temperature prior to admission into the magazine of a cigarette maker. An alternative method is described in U.S. Pat. No. 3,734,104 to Buchanan, et al., in which high moisture cut stems (about 24 to 60 percent by weight) are subjected to a hot gas containing at least 30 percent steam, whereby the moisturized stems are heated to about 250° to 750° F. for from about 0.5 to 5 seconds. By this process, the filling capacity of the expanded cut stems is increased from 30 to 60 percent or more. A relevant technique is available in U.S. Pat. No. 4,186,755 to Schmidt, not illustrated.

According to these prior patents, tobacco stems can be moisturized by hot water or steam, and then rapidly dried to increase the filling capacity of tobacco. However, those prior methods require expensive chemicals and special apparatus which cause an increase in the production costs. Especially, in the case of microwave or high-frequency energy treatment, uneven properties and blown spots are likely developed on the tobacco. When treating at a high temperature, the tobacco loses its fragrance and a large amount of waste tobacco is produced.

SUMMARY OF THE INVENTION

The previously described problems incurred by conventional methods and apparatus for puffing tobacco stems have been readily solved through the present invention.

The primary object of the invention therefore is to provide a novel and improved tobacco conditioning method in which the drawbacks of presently known methods are overcome.

Another object of the invention is to provide a method is which the smoking taste can be highly enhanced by reducing chlorine components in the tobacco stems and leaves.

A further object of the invention is to provide a method which insures the efficiency of the successive expansion of the tobacco for a very short period of time.

Still another object of the invention is to provide a method in which a desirable filling capacity can be obtained.

A further object of the invention is to provide an apparatus for performing the function required by the method of the present invention.

These and other objects can be attained by the process of the present invention which comprises preparing rolled, cut tobacco stems having a desired particle size and moisture content; supplying said stems into a U-shaped, tubular expansion device by means of a suction force produced by superheated steam being ejected downward from a steam nozzle positioned in a venturi tube, said tube being present in position between the bottom end of a hopper for said stems and the upper end of the inlet of said expansion device; subjecting momentarily said stems to the action of the steam pressure and heat to expand said stems to a certain extent in said expansion device; exposing suddenly the expanded stems to an atmospheric pressure; and removing moisture from the mixture of said stems and steam by means of hot air, said hot air flowing in the same direction as the stream of said mixture or countercurrent thereto.

Cut tobacco stems, used in the invention, commonly have a moisture content of 25% to 35%. When the moisture content is above 35%, brown spots are likely to appear on the tobacco stems, when the moisture content is below 25%, waste tobacco is likely to be produced. In the invention, the reduction of waste tobacco can be produced by using a steam pressure of about 0.5 to about 1.5 kg/cm$^2$.G. In utilization of the invention, it is important to supply superheated steam, having a temperature ranging from 95° to 150° C. at a pressure of about 0.5 to 1.5 kg/cm$^2$.G, from the steam nozzle pointed downward at a certain distance from the horizontal center line of the narrow neck defined in the venturi tube. When the steam is ejected downward to the neck under a pressure in the above range, a suction force is created in the neck of the venturi tube and therefore, tobacco stems are sucked in the expansion device. This suction can be understood well by Bernoulli's principle. For this purpose, it is necessary that the ratio of the inner diameter of the nozzle to that of the narrow neck of the venturi tube be about 1:18. The flow rate of hot steam is about 50 to 130 m/sec. Cut tobacco stems to be treated are supplied into the venturi tube by means of a free fall, that is, gravity, from a hopper vessel expanded upward from the tube. Upon reaching the steam, each of the particles of the cut stems are evenly distributed by the steam force into the expansion device. The steam momentarily acts on the stem particles utilizing Newtonian force and simultaneously the particles are exposed to the Hook repulsion force corresponding to the Newtonian force. Thus, an extension stress acts on the cell structure of the stems which were shrunk before treatment by drying. Hot steam impregnates the cell structure by virtue of a momentary outer pressure. Simultaneously, moisture or vapors contained in unexpanded cell structures are forced to escape out of the cell. By this action, the cell structures of tobacco stems are forced to expand.

In general, the tobacco stems contain chlorine of about 1 to 1.6 wt.% based on the dried stems. In order to reduce the content of chlorine, the stems should, in advance, be dipped for about 5 to 10 minutes in water or any other polar solvent, such as an alcohol.

According to the invention, tobacco stems are treated by conveying the stems together with a stream of superheated steam into a U-shaped, tubular expansion device.

BRIEF DESCRIPTION OF THE DRAWINGS

The accompanying drawings illustrate in detail one embodiment of the invention, and, together with the description, serve to explain the principles of the invention.

DETAILED DESCRIPTION OF THE INVENTION

Figure 1:
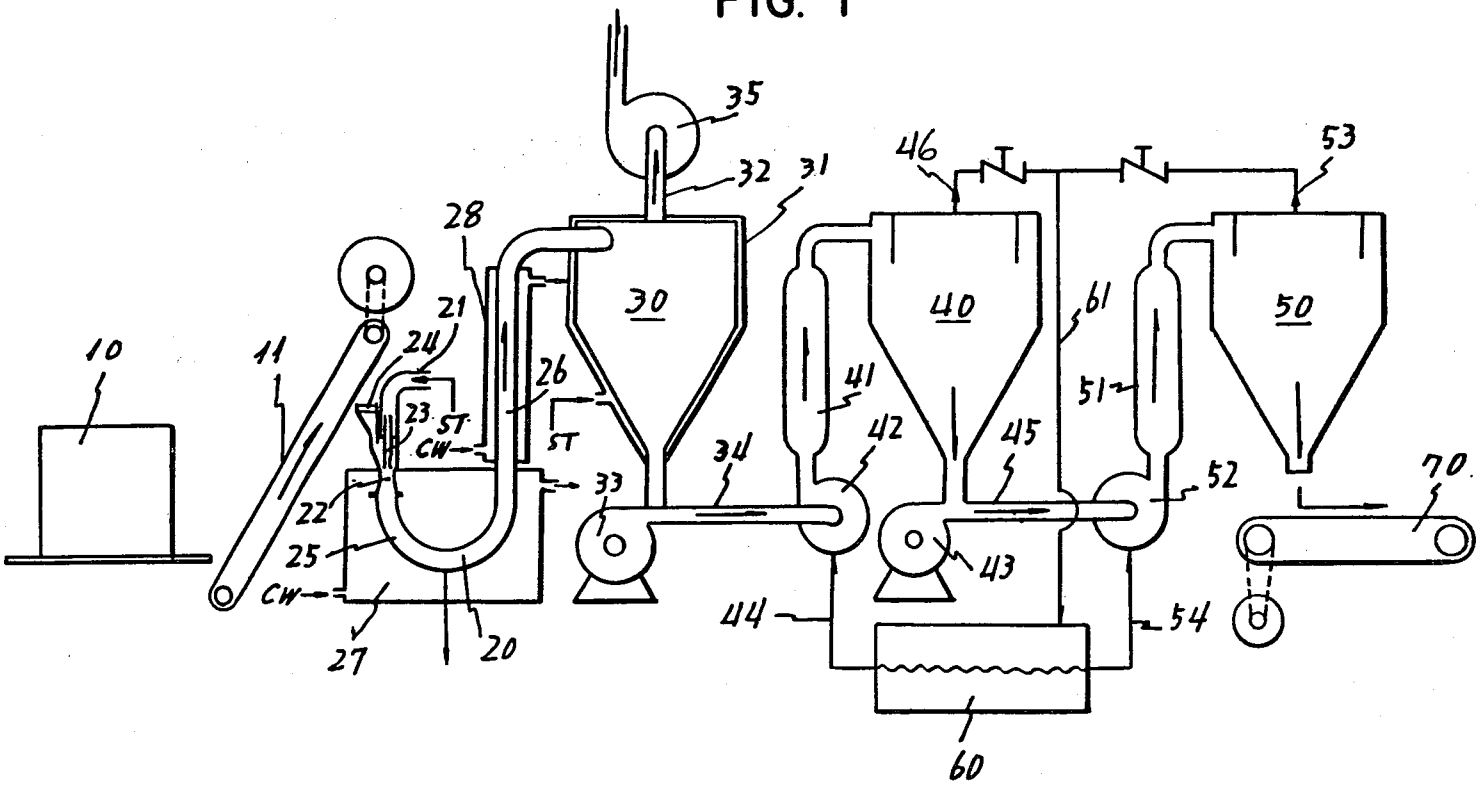
FIG. 1 illustrates a schematic partly elevational and partly longitudinal vertical sectional view of an apparatus for performing the invention.
Figure 2:
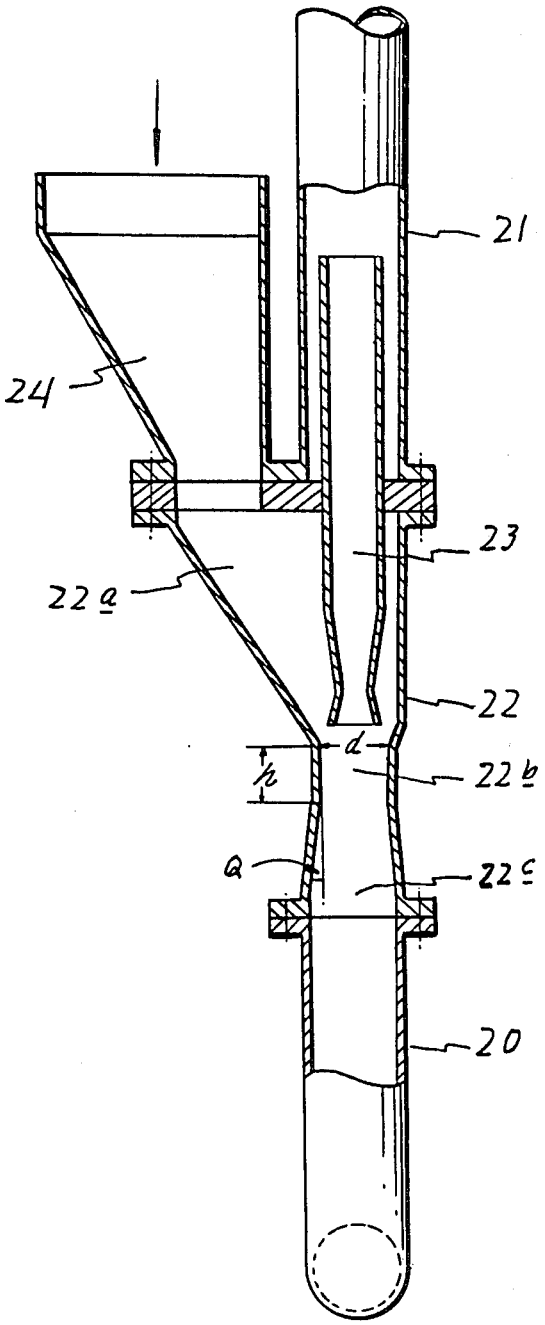
FIG. 2 illustrates an enlarged representation of a venturi tube according to the invention wherein superheated steam and tobacco stems are simultaneously supplied.

Referring now to FIGS. 1 and 2, superheated steam, having a temperature ranging from 95° to 150° C., produced in a boiler, not shown, is sent to a U-shaped, tubular expansion device 20 via a steam line 21, which is opened into the upper inlet of the expansion device 20 at a distance over the inlet port of the narrow neck defined in a venturi tube 22, and forms a steam nozzle 23 at the end tip. The steam line 21 supplied with steam ST in the direction shown by the arrow may be provided with a pressure o.k. and a steam gauge, not shown, at a proper position thereof. A hopper 24 is mounted on the upper end of the expansion device 20 for charging tobacco stems to be treated. Cut rolled tobacco stems are supplied from a tobacco cutter (e.g., AMF Mill Cutter III) 10 to the hopper 24 via a conveyor 11.

The inner diameter of the steam nozzle should be smaller than that of the narrow neck of the venturi tube 22, so that when high pressure steam is ejected from the nozzle 23, tobacco stems can be sucked, together with the ejected steam, into the expansion device 20. In a preferred embodiment of the invention, the ratio of the diameter of the nozzle to the neck is 1:18, and the nozzle is positioned over the center line of the neck at the same distance as the diameter of the neck.

The U-shaped, tubular, expansion device 20 is formed such that one tube end 25 of the device is adjoined to the hopper 24, while the opposite tube end 26 stands vertically and is connected to the upper end of a cyclone 30. According to a design of the U-shaped tube 20, the tube has an inner diameter of 50 mm, a radius of curvature of 300 mm and a total length of 3000 mm. In order to ensure high performance, it is recommended that the length of tube end 26 be longer than the other tube end 25. A length ratio of 1:2 is recommended. The cyclone 30 is installed to separate the moisture from the mixture of tobacco stems treated with steam. The cyclone 30 is provided with a surrounding steam jacket 31 for pre-heating the cyclone, and an exhaust port 32 and blower 33 for supplying hot air from an air-heater, hereafter described, into the cyclone 40.

The venturi tube 22 is formed by a funnel-shaped upper end **22*a*, a narrow neck 22*b* and an expanded lower end 22*c*, as shown in FIG. 2. According to the embodiment of the invention, it is preferred that the ratio of the diameter d to the height h of the narrow neck is 1:1. The angle Q, which is defined between the portions 22*b* and 22*c*, is about 3° to 9°, preferably 5°. This angle reduces the abrasion or friction coefficient acting on the narrow neck 22*b* and inhibits any swirling phenomenon of materials and gases in the expanded portion 22*c***.

When the mixture of tobacco stems and an excess of steam admixed in the expansion device 20 is introduced into the cyclone 30, steam and other vapors are separated from expanded stems and vented through the exhaust port 32, by means of the upper blower 35, while tobacco stems pass through the outlet pipe 34 by means of air from the blower 33. When the expansion device 20 is operated for a prolonged period of time, it is likely to cause clogging of the piping systems due to waste tobacco or deposition of the same materials on the inner wall of the device. In order to solve this problem, the expansion device 20 is provided with surrounding cooling jackets 27 and 28.

These cooling jackets 27 and 28 having cooling water inlets CW operate to maintain the external temperature of the expansion device 20 at about 55° to 100° C. The steam jacket 31 having heating steam inlet ST preheats the mixture of tobacco stems and hot steam withdrawn from the device 20 to about 90–95° C. so that a sufficient amount of water vapor can be separated without producing condensated water in the cyclone 30. An excess of water in the cooling jackets 27 and 28 may be withdrawn from a drain valve, not shown, located in the cooling jacket 27.

Tobacco stems are primarily expanded in the tubular device 20 at an expansion rate of about 60 to 70 percent, and further expansion is achieved by passing them through a subsequent installation, such as cyclone 30.

Tobacco stems having a moisture content of about 12 percent, treated in the first cyclone 30, successively pass through second and third cyclones 40 and 50 respectively, and are dried by hot air which is cycled into the cyclones 40 and 50 from the air heater 60 in which air is heated to 95–150° C. by hot steam.

Tobacco stems thus dried are conveyed to a destination conveyor 70 for expanded tobacco stems.

The hot air from the heater 60 is supplied to the cyclones 40 and 50 through the rising pipes 41 and 51 via the blowers 42 and 52 and the leading pipes 44 and 54. The moisture-containing hot air, which has been separated in the cyclones 40 and 50 is returned to the heater 60 through the pipes 46 and 53, and a manifold 61, to recycle the hot air. The hot air from the leading pipes 44 and 54, and the tobacco stems separated in the cyclones 30 and 40, respectively pass through the outlet pipes 34 and 45 by means of blowers 33 and 43, and meet at the blowers 42 and 52. The mixture of expanded tobacco stems and hot air goes upward along the rising pipes 41 and 51 to the cyclones 40 and 50, respectively.

From the foregoing, it will be noted that according to the invention, raw tobacco stems and superheated steam are concurrently supplied, and hot air flows in the same direction as the stream of the expanded tobacco stems. Furthermore, it should be understood that according to the invention, two or more U-shaped, tubular expansion devices can be arranged in parallel.

The important advantages of the invention are that a high quality tasteful tobacco can be obtained, while reducing and considerably eliminating brown spots. The treatment of the tobacco must be at a temperature in the range of 95° to 150° C. under a pressure of 0.5 to 1.5 kg/cm$^2$.G.

The following specific description is given to enable those skilled in the art to more clearly understand and practice the present invention. It is not meant to be a limitation upon the true scope of the invention, but merely to be illustrative and representative thereof.

EXAMPLE 1

Hicks (flue cured tobacco) stems were cut to a rolled thickness of 1.0 to 2.0 mm and a cut width of 0.15 to 0.25 mm by passing them through a cutter (AMF Company, Model-MM 3). The resulting stem pieces (30% by weight moisture content) were charged, together with steam at 150° C. under 1 kg/cm$^2$.G, in an expansion device having a diameter of 5 cm and a whole length of 300 cm and then momentarily treated for 1/30 second.

When the rate of treatment was 600 g/min., the sieving results in percentage of cut stems on the basis of the size of samples (3.35 mm; 1.0 mm; 0.5 mm; and below 0.5 mm) are set forth in Table I.

TABLE I

| RT* (mm) | CW** (mm) | Treatment | Sieving Results >3.35mm | 3.35–1.0mm | 1.0–0.5mm | <0.5mm or dust |
|---|---|---|---|---|---|---|
| 1.0 | 0.15 | NO | 16.63 | 68.36 | 11.42 | 3.38 |
| 1.0 | 0.15 | YES | 38.44 | 48.00 | 8.20 | 5.26 |
| 1.0 | 0.25 | NO | 22.26 | 65.06 | 9.92 | 2.34 |
| 1.0 | 0.25 | YES | 36.45 | 58.34 | 12.14 | 2.95 |
| 1.5 | 0.15 | NO | 21.13 | 66.16 | 9.21 | 2.41 |
| 1.5 | 0.15 | YES | 57.08 | 35.26 | 4.42 | 2.96 |
| 1.5 | 0.25 | NO | 16.18 | 75.40 | 5.60 | 1.38 |
| 1.5 | 0.25 | YES | 49.18 | 46.48 | 2.46 | 1.18 |
| 2.0 | 0.15 | NO | 13.41 | 75.06 | 9.15 | 2.00 |
| 2.0 | 0.15 | YES | 43.54 | 38.50 | 4.52 | 2.96 |
| 2.0 | 0.25 | NO | — | — | — | — |
| 2.0 | 0.25 | YES | 55.84 | 39.58 | 2.88 | 1.52 |

*RT:Rolled Thickness
**CW:Cut Width

EXAMPLE 2

The procedure of Example 1 was repeated, except that the sample was introduced, together with steam of 150° C. and 0.5 kg/cm$^2$.G, into the same expansion device as used in Example 1, at a rate of 500 g/min. The resulting product was used to prepare a cigarette without a filter, having a length of 6 mm and a circumference of 25 mm. The physical and chemical properties of the cigarette are shown in Table II.

TABLE II

| RT* (mm) | CW** (mm) | Treatment | Weight of Unit Cigarette (g) | Filling Capacity (cc/g) | Rate of combustion (min., sec./3cm) | Tar (mg/cig.) | Nicotine (mg/cig.) |
|---|---|---|---|---|---|---|---|
| 1.0 | 0.15 | NO | 1.25 | 3.85 | 8'06 | 12.7 | 0.44 |
| 1.0 | 0.15 | YES | 0.50 | 7.53 | 4'09 | 4.3 | 0.20 |
| 1.0 | 0.25 | YES | 0.75 | 5.90 | 4'09 | 7.1 | 0.23 |
| 1.5 | 0.15 | YES | 0.65 | 7.88 | 4'05 | 4.1 | 0.17 |
| 2.0 | 0.15 | YES | 0.55 | 7.31 | 4'07" | 6.6 | 0.20 |

*RT: Rolled Thickness
**CW: Cut Width

EXAMPLE 3

Samples made in Example 1 were dipped in water (or a polar solvent) for 10 minutes in order to reduce the amount of chlorine contained in the sample. Thereafter, the procedure of Example 1 was repeated. The amounts of the extracted chlorine pursuant to the dipping time are shown in Table III.

TABLE III

| Samples | Dipping Time (min.) | Cl-Content (%) | Reduction of Cl. (%) | Expansion Efficiency | Smoking Taste |
|---|---|---|---|---|---|
| Control | 0 | 1.54 | 0 | no good | no good |

TABLE III-continued

| Samples | Dipping Time (min.) | Cl- Content (%) | Reduction of Cl. (%) | Expansion Efficiency | Smoking Taste |
|---|---|---|---|---|---|
| Sample | 3 | 0.67 | 56.5 | good | good |
| Sample | 5 | 0.64 | 64.9 | good | good |
| Sample | 10 | 0.64 | 64.9 | good | good |

What is claimed is:

1. A process for expanding tobacco stems with superheated steam which comprises:

preparing rolled, cut tobacco stems having a desired particle size and moisture content; supplying said stems into a U-shaped, tubular expansion device by means of a suction force produced by superheated steam being ejected downward from a steam nozzle positioned in a venturi tube, said tube being present in position between the bottom end of a hopper for said stems and the upper end of the inlet of said expansion device;

subjecting momentarily said stems to the action of the steam pressure and heat to expand said stems to a certain extent in said expansion device;

exposing suddenly the expanded stems to an atmospheric pressure for further expansion; and removing moisture from the mixture of said stems and steam by means of hot air flowing through the stream of said mixture.

2. The process according to claim 1 wherein the average particle size of said rolled cut tobacco stems is about 1.0 to 2.0 mm in rolled thickness and about 0.15 to 0.35 mm in cut width.

3. The process according to claim 1 wherein the moisture content of said stems before treatment is 25 to 30 percent.

4. The process according to claim 1 wherein the temperature and the pressure of said steam are within the respective ranges of 95° to 150° C. and 0.5 to 1.5 $Kg/Cm^2.G$.

5. The process according to claim 1 wherein said stems are expanded in a time less than 0.1 second.

6. Apparatus for expanding tobacco stems with superheated steam which comprises:

a hopper for receiving said stems from a storage tank;

at least one U-shaped tubular expansion device, one tube end forming said device being longer than the other, and the shorter end having an inlet port;

a venturi tube installed in the shorter end inlet port of said expansion device;

a steam nozzle positioned the upper part of said venturi tube; and at least one cyclone wherein an excess of moisture is removed, the first cyclone being connected to the longer tube end of said expansion device.

7. Apparatus according to claim 6 wherein said U-shaped device is provided with a cooling jacket for cooling down the external temperature of said device to from about 50° to about 100° C.

8. Apparatus according to claim 6 wherein said venturi tube has a narrow neck, a funnel-shaped upper end and an expanded lower end.

9. Apparatus according to claim 8 wherein the ratio of the diameter to the height of said narrow neck is 1:1.

10. Apparatus according to claim 8 wherein the angle of inclination of said expanded lower end to said narrow neck is within about 3° to 9°.

11. Apparatus according to claim 6 wherein said steam nozzle is positioned at a distance over the inlet port of said narrow neck.

12. Apparatus according to claim 11 wherein the diameter of said nozzle is about 1/18 of that of said narrow neck.

13. Apparatus according to claim 6 wherein the first of said cyclones is provided with a steam jacket for preheating said first cyclone.

14. Apparatus according to claim 13 wherein said first cyclone is preheated to 90° to 110° C.

15. Apparatus according to claim 6 wherein said cyclones are provided with a hot air recycling system.

* * * * *

UNITED STATES PATENT AND TRADEMARK OFFICE

CERTIFICATE OF CORRECTION

PATENT NO. : 4,418,706

DATED : 6 December 1983

INVENTOR(S) : Ki-Hwan Kim; Kwang-Keun Yoo; & Tae-Ho Lee

It is certified that error appears in the above-identified patent and that said Letters Patent are hereby corrected as shown below:

In the text, Column 4, line 27;
"pressure o.k. and a steam gauge, not shown, at a proper"
should read:
--pressure gauge and a steam gauge, not shown, at a proper--

Signed and Sealed this

*Twenty-eighth* Day of *February 1984*

[SEAL]

*Attest:*

GERALD J. MOSSINGHOFF

*Attesting Officer*

*Commissioner of Patents and Trademarks*